US007600743B2

(12) United States Patent
Dorin et al.

(10) Patent No.: US 7,600,743 B2
(45) Date of Patent: Oct. 13, 2009

(54) CONVECTOR FOR COOLING OF A FLUID CIRCULATING IN A PIPE

(75) Inventors: Filippo Dorin, Florence (IT); Riccardo Paoletti, Florence (IT)

(73) Assignee: Frigel Firenze S.p.A., Firenze (IT)

( * ) Notice: Subject to any disclaimer, the term of this patent is extended or adjusted under 35 U.S.C. 154(b) by 0 days.

(21) Appl. No.: 11/997,478

(22) PCT Filed: Jul. 24, 2006

(86) PCT No.: PCT/IT2006/000561

§ 371 (c)(1),
(2), (4) Date: Jun. 12, 2008

(87) PCT Pub. No.: WO2007/015281

PCT Pub. Date: Feb. 8, 2007

(65) Prior Publication Data

US 2009/0115080 A1 May 7, 2009

(30) Foreign Application Priority Data

Aug. 3, 2005 (IT) ..... FI2005A0173

(51) Int. Cl.
*B01F 3/04* (2006.01)

(52) U.S. Cl. ..... 261/152; 165/60; 165/903; 261/112.2; 261/129; 261/156

(58) Field of Classification Search ..... 261/111, 261/112.1, 112.2, 129, 152, 153, 156, DIG. 11, 261/DIG. 46, DIG. 77; 165/60, 900, 903; 62/304, 314

See application file for complete search history.

(56) References Cited

U.S. PATENT DOCUMENTS 1,847,845 A * 3/1932 Mullen ..... 95/213

(Continued)

FOREIGN PATENT DOCUMENTS

EP 1 477 756 A1 11/2004

(Continued)

*Primary Examiner*—Richard L Chiesa
(74) *Attorney, Agent, or Firm*—McGlew and Tuttle, P.C.

(57) ABSTRACT

The convector includes at least one finned tube bundle (7) in the tubes of which a fluid to be cooled is made to circulate and at least one fan (11) producing an air flow that strikes the outside of said finned tubes. The convector includes an adiabatic chamber (13) through which a air flow (F1) passes, positioned upstream of the tube bundle (7), inside which water is nebulized and vaporized. The adiabatic chamber (13) is defined by side walls (5) and by at least two evaporation honeycomb fill packs (15, 17).

12 Claims, 3 Drawing Sheets

U.S. PATENT DOCUMENTS

| | | | | |
|---|---|---|---|---|
| 7,128,310 | 2,326,674 | * | 12/1943 | Crawford |
| ..... 95/91 | 3,052,105 | * | 9/1962 | Bowman et al. |
| ..... 62/305 | 3,353,799 | * | 11/1967 | Lions et al. |
| ..... 261/3 | 3,731,461 | * | 5/1973 | Hamon |
| ..... 96/356 | 3,865,911 | * | 2/1975 | Lefevre |
| ..... 261/140.1 | 3,917,764 | * | 11/1975 | Phelps |
| ..... 261/111 | 3,994,999 | * | 11/1976 | Phelps |
| ..... 261/159 | 4,315,873 | * | 2/1982 | Smith et al. |
| ..... 261/158 | 4,367,183 | | 1/1983 | Carbonaro |
| | 4,662,902 | * | 5/1987 | Meyer-Pittroff |
| ..... 96/53 | 5,724,828 | * | 3/1998 | Korenic |
| ..... 62/305 | 6,663,087 | * | 12/2003 | Hubbard et al. |
| ..... 261/152 | B2 * | | 10/2006 | Mockry et al. |
| 2001/0002620 | A1 * | | 6/2001 | Carter et al. |
| 2003/0070547 | A1 * | | 4/2003 | Hubbard et al. |

..... 261/112.1
..... 165/201
..... 95/288

FOREIGN PATENT DOCUMENTS

| | | | | |
|---|---|---|---|---|
| JP | 52-64040 | A * | 5/1977 | ..... 261/152 |
| JP | 54-16748 | A * | 2/1979 | ..... 261/DIG. 77 |
| JP | 60-232492 | A * | 11/1985 | ..... 261/DIG. 77 |
| WO | WO 2004/085946 | A1 | 10/2004 | |

* cited by examiner

CONVECTOR FOR COOLING OF A FLUID CIRCULATING IN A PIPE

This is the national stage of International Application No. PCT/IT2006/000561, filed on Jul. 24, 2006.

TECHNICAL FIELD

The present invention relates to a convector for cooling a fluid circulating in a pipe, for example a pipe conveying a cooling liquid coming from a plastic processing plant. The convector comprises at least one finned tube bundle, in the tubes of which said fluid to be cooled is made to circulate, and at least one fan which produces an air flow that strikes the outside of said finned tubes to cool the fluid.

BACKGROUND OF THE INVENTION

In order to increase the cooling capacity of a convector lowering the delivery temperature of the process fluid even below the temperature of the ambient air, it is common practice to spray the tube bundle thereof with nebulized water which, evaporating into the air flow of the fan, lowers the temperature of said air flow and therefore also the temperature of the process fluid. Nonetheless, the water that evaporates leaves, on the tube bundle and on the fins thereof, deposits of the salts contained therein, e.g. lime and others. The accumulation of salts in the long term causes a reduction in the heat exchange capacity of the convector and thus makes it necessary to perform costly maintenance thereon and/or prior demineralization of the water to be nebulized resulting in increased costs. Existing systems are always provided with a plant for recirculation of the nebulized water, which has not yet evaporated, with a respective bleed valve to maintain the concentration of salts at acceptable levels.

OBJECTS AND SUMMARY OF THE INVENTION

The present invention aims at avoiding these drawbacks. According to the invention, the convector comprises a chamber, through which the convector air flow passes, and which is arranged upstream of said tube bundle, with respect to the air flow. Inside the chamber water is nebulized by means of spray nozzles. According to the invention, the chamber—hereinafter in the present description referred to as "adiabatic chamber" as heat exchanges between the air flow and the walls of the chamber are neglibile—is defined by side walls and by at least two evaporation fill packs positioned in the chamber at the beginning and at the end of the chamber, in the direction in which the air flow passes therethrough. Preferably, said fill packs are honeycomb fill packs. The nebulized water that does not vaporize directly inside the chamber wets the overall large surface of the cells of said honeycomb fill packs and continues to vaporize thereon. In this way the injected water absorbs evaporation heat from the air flow, cooling said flow before this passes through the tube bundle and thereby lowering the delivery temperature of the process fluid.

According to a preferred embodiment of the invention, the convector comprises control means for regulating the flow rate of the nebulized water injected into the adiabatic chamber as a function of the temperature and/or of the humidity of the ambient air, and/or of the temperature of the process fluid and/or of the speed of the air flow generated by the fans, so that all the injected water is vaporized in the chamber and in the honeycomb fill packs, thus preventing wetting of the tube bundles and dispersal of water into the environment.

In this way it is not necessary to demineralize or recycle the water, and salt deposits do not accumulate on the finned tube bundle. The only maintenance required is periodic cleaning or changing of the honeycomb fill packs on which the salts contained in the injected water have deposited. These fill packs—which, owing to their form, have a limited cost—are available on the market and are composed of a plurality of thin plastic sheets placed side by side and partly attached to one another, the layers being pleated to form a number of ducts of small diameter through which the air flow generated by the fans of the convector can pass. In this way the still liquid water particles contained in the air flow delivered from the adiabatic chamber are deposited in the ducts of the honeycomb fill packs which have deviations of direction and a relatively large contact surface with the air flow, promoting evaporation.

Said control means of the convector according to the invention can comprise temperature and humidity sensors of the ambient air connected to a control circuit, and a valve to regulate the flow rate of the water to be nebulized operated by said control circuit to ensure complete evaporation of the water before it reaches the finned tube bundle.

The adiabatic chamber can also comprise other evaporation honeycomb fill packs besides those at the beginning and end of the chamber, between them and distanced therefrom, the water injection nozzles being positioned between one or more pairs of adjacent fill packs. Preferably, said nozzles spray water counter-current to the air flow inside the adiabatic chamber.

BRIEF DESCRIPTION OF THE DRAWINGS

The invention will be more apparent by following the description and accompanying drawing, which shows a non-limiting example of said invention. In the drawing.

DETAILED DESCRIPTION OF AN EMBODIMENT OF THE INVENTION

Figure 1:
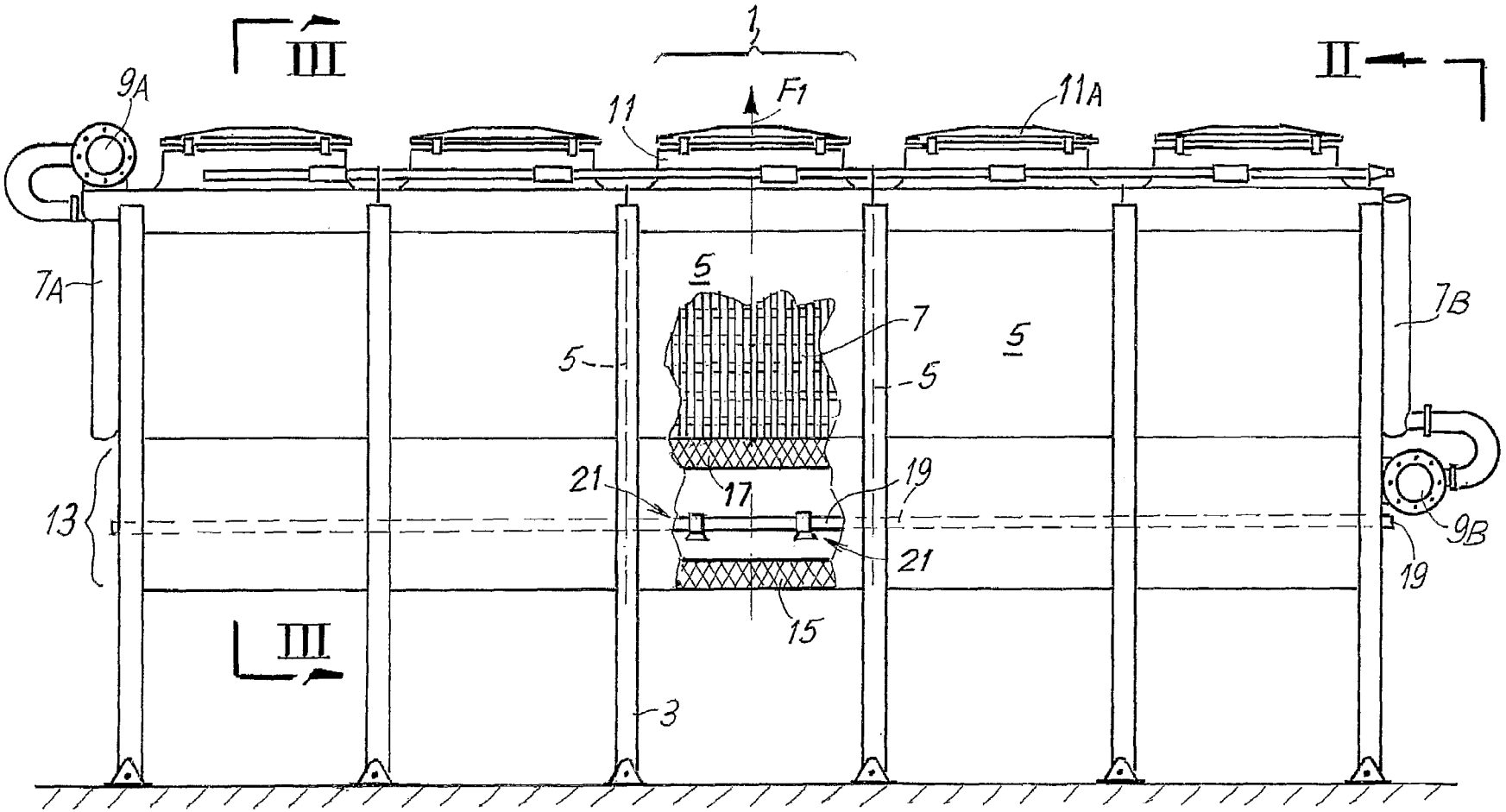
FIG. 1 shows a side view of a convector with five fans with a partially removed side covering panel.
Figure 3:
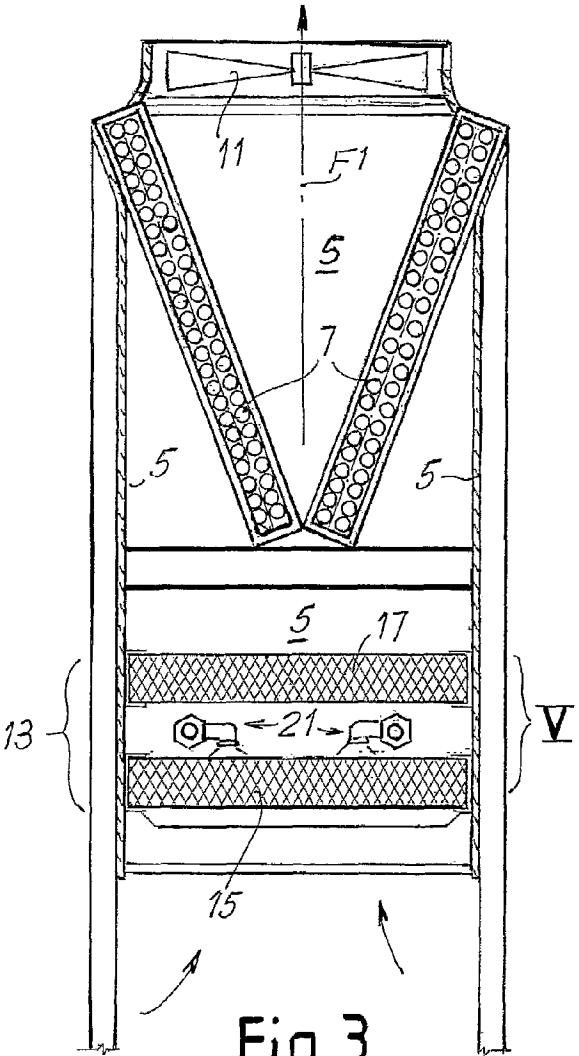
FIG. 3 shows an enlarged sectional view according to III-III of the convector in FIG. 1.
Figure 4:
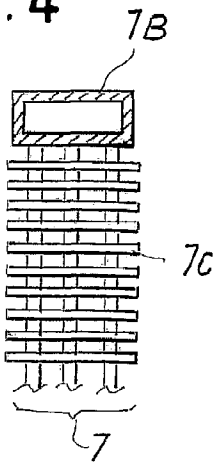
FIG. 4 shows an enlarged sectional view according to IV-IV in FIG. 2.
Figure 2:
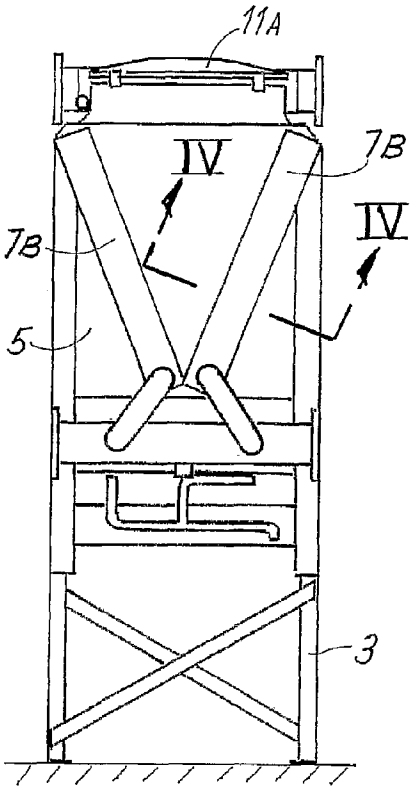
FIG. 2 shows a view according to II-II of the convector in FIG. 1.
Figure 6:
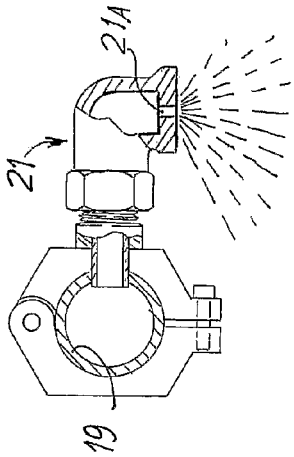
FIG. 6 shows an enlargement of the detail VI in FIG. 5.

With reference to FIGS. 1 and 2, the convector for cooling a liquid circulating in a pipe comprises a structure with five modules, such as the one indicated with the reference numeral 1, adjacent to one another and provided with vertical legs 3 resting on the ground, the modules being separated laterally from one another and from the outside environment by sheet metal panels 5. A pair of finned tube bundles 7 (see also FIG. 3) positioned in a V passes through the entire assembly of modules 1 from left to right (with reference to FIG. 1). The tube bundles are equipped at the ends with inlet and outlet manifolds, designated 7A, 7B respectively (see also FIG. 4), which are in fluid communication with sections 9A, 9B of respective feed and delivery branches of a pipe, in which the fluid to be cooled circulates.

Each module 1 comprises a fan 11 with a vertical axis, upwardly protected by a grille 11A, which produces an air flow according to the arrow F1 (FIG. 1), passing through the module, and consequently through the respective portion of tube bundle 7, from the bottom towards the top. The tubes of the tube bundles 7 have fins 7C (FIG. 4) to increase heat exchange between the liquid circulating in the pipes and the air flow produced by the fan 11.

Figure 5:
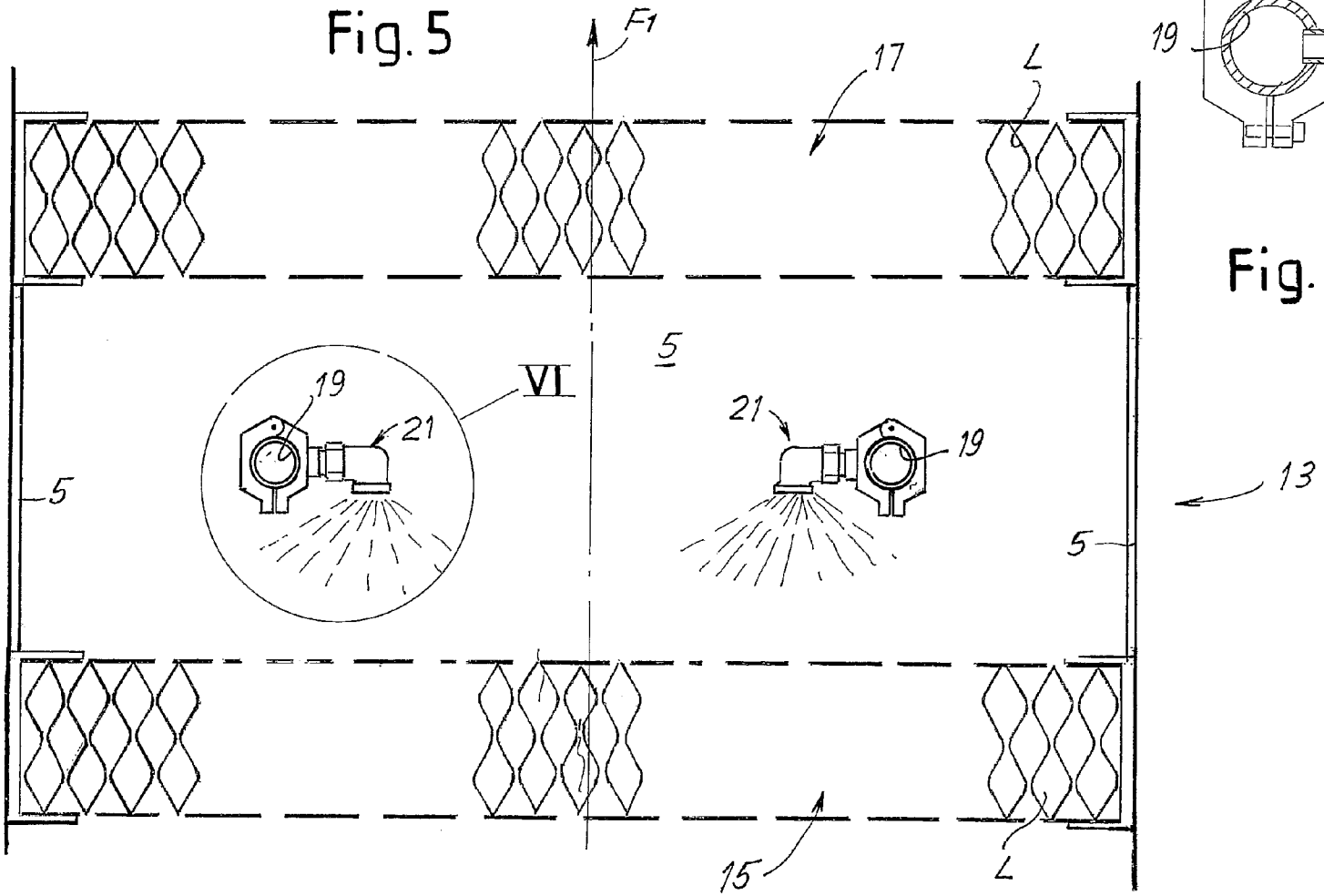
FIG. 5 shows an enlargement of the detail V in FIG. 3.

According to the invention, each module 1 of the convector has—upstream of the tube bundles 7 in the direction of the air flow according to F1—a chamber 13, called "adiabatic chamber", delimited laterally by the panels 5 and, in the direction of flow F1, by a fill pack 15 at the inlet and by a fill pack 17 at the outlet (see also FIG. 5). The fill packs 15, 17 may be advantageously honeycomb fill packs. In a known way, fill packs, and in particular honeycomb fill packs are composed of pleated or corrugated plastic layers L, said layers being placed side by side and glued to one another to form, with the respective pleats, a series of small tubes inclined with respect to the vertical, suitable to allow the air flow according to F1 to pass through and to offer a large contact surface with said flow. Passing through the assembly of modules 1, at the level of the respective adiabatic chambers 13, are a pair of water supply pipes 19, attached to which, in each chamber 13, are sprayers 21 in fluid communication with said pipes 19. The pipes 19 contain pressurized water, e.g. at 2-4 bar, and the sprayers 21 (see FIG. 5) have respective nozzles 21A directed downwards, i.e. in the opposite direction to the flow F1. The nozzles 21A have a relatively small diameter, for example a few tens of millimeter, to finely nebulize water inside the adiabatic chamber.

The convector also comprises a controller of the flow rate of water to be nebulized in the pipes 19 as a function of the speed of the fan 11 (and therefore of the air flow according to F1), and/or of the temperature and humidity of the outside air and/or of the temperature of the process fluid determined by means of specific sensors (not shown in the drawing). The controller, e.g. by means of timed regulation of a specific on-off valve, varies the flow rate of the water so that:

- the water sprayed finely inside each adiabatic chamber 13 and which—conveyed by the flow according to F1—wets the tubes of the fill pack 17, is completely evaporated at the outlet thereof, so that the air flow delivered from the fill pack 17 does not contain particles of liquid water, thereby preventing wetting of the finned tube bundles 7 and salt deposits from accumulating thereon;
- the water that falls onto the inlet fill pack 15 of the adiabatic chamber evaporates completely before reaching through gravity the inlet of the fill pack 15, preventing it from falling and being dispersed on the ground.

It is understood that the drawing only shows an example provided by way of a practical demonstration of the invention, which can vary in forms and arrangements without however departing from the scope of the concept underlying the invention. Any reference numerals in the appended claims are provided to facilitate reading of the claims with reference to the description, and do not limit the scope of protection represented by the claims.

The invention claimed is:

1. A convector for cooling a fluid circulating in a pipe, comprising:

- a finned tube bundle for circulating a fluid to be cooled;
- a fan for producing an air flow such that said air flow contacts an outside surface of said finned tube bundle;
- an adiabatic chamber through which said air flow passes, said adiabatic chamber being positioned upstream of said tube bundle with respect to the air flow direction, water being nebulized inside the chamber through nebulizer nozzles, said adiabatic chamber being defined by side panels and by at least two evaporation fill packs positioned in the chamber respectively at an inlet and outlet thereof, in the direction in which the air flow passes therethrough, the air passing through said fill packs and the adiabatic chamber such that the air vaporizes the injected water by transferring thereto evaporation heat, whereby the air is cooled before passing through the tube bundle.

2. Convector as claimed in claim 1, wherein said fill packs are formed by a plurality of thin pleated sheets placed side by side to form a plurality of ducts of small diameter through which the air flow generated by said fan passes.

3. Convector as claimed in claim 1, wherein said fill packs are honeycomb fill packs.

4. Convector as claimed in claim 1, further comprising a control means for regulating the flow rate of the nebulized water injected into the adiabatic chamber as a function of at least a controlled parameter.

5. Convector as claimed in claim 4, wherein said parameter is selected from the group including: the temperature of the ambient air; the humidity of the ambient air; the temperature of the fluid to be cooled; or combination thereof; wherein the water injected into the air flow is vaporized before the air flow contacts the tube bundle such that said tube bundle does not get wet and salts are not deposited thereon and the dispersal of water into the environment is prevented.

6. Convector as claimed in claim 4, wherein said control means comprise at least a sensor for said at least one parameter and a valve to regulate the flow rate of the water to be vaporized connected to a control circuit, the water being supplied via pipes connected to the nozzles inside the adiabatic chamber and said valve being operated by said control circuit.

7. Convector as claimed in claim 1, wherein the adiabatic chamber comprises further evaporation honeycomb fill packs besides those at the inlet and outlet of the chamber, distanced from one another and therefrom, water injecting nozzles being positioned between one or more pairs of said adjacent fill packs.

8. Convector as claimed in claim 1, wherein said nozzles spray water to be vaporized counter-current to the air flow inside the adiabatic chamber.

9. Convector as claimed in claim 2, wherein said fill packs are honeycomb fill packs.

10. Convector as claimed in claim 2, further comprising a control means for regulating the flow rate of the nebulized water injected into the adiabatic chamber as a function of at least a controlled parameter.

11. Convector as claimed in claim 3, further comprising a control means for regulating the flow rate of the nebulized water injected into the adiabatic chamber as a function of at least a controlled parameter.

12. Convector as claimed in claim 10, wherein said parameter is selected from the group including: the temperature of the ambient air; the humidity of the ambient air; the temperature of the fluid to be cooled; or combination thereof wherein the water injected into the air flow is vaporized before the air flow contacts the tube bundle such that said tube bundle does not get wet and salts are not deposited thereon and the dispersal of water into the environment is prevented.

* * * * *